US005727579A

United States Patent [19]

Chardack

[11] Patent Number: 5,727,579

[45] Date of Patent: Mar. 17, 1998

[54] AUTOMATIC HAND WASHING AND DRYING APPARATUS INCLUDING COMBINED BLOW DRYING MEANS AND TOWEL DISPENSING MEANS

[76] Inventor: William M. Chardack, 547 Golfview Dr., Gulfstream, Fla. 33483

[21] Appl. No.: 654,693

[22] Filed: May 29, 1996

[51] Int. Cl.[6] ..... B08B 3/02

[52] U.S. Cl. ..... 134/95.2; 134/113; 134/102.3; 134/115 R; 382/380; 4/630

[58] Field of Search ..... 134/901, 95.2, 134/113, 102.3, 115 R; 4/628, 630, 623, 619, 639; 15/312.1; 392/380

[56] References Cited

U.S. PATENT DOCUMENTS

| | | | |
|---|---|---|---|
| Re. 33,810 | 2/1992 | Strieter | 134/99 |
| 2,826,763 | 3/1958 | Bass | 4/158 |
| 3,059,815 | 10/1962 | Parsons, Jr. . | |
| 3,220,424 | 11/1965 | Nelson . | |
| 3,699,984 | 10/1972 | Davis | 134/95 |
| 3,744,149 | 7/1973 | Helbling | 34/202 |
| 3,757,806 | 9/1973 | Bhaskar et al. . | |
| 3,817,651 | 6/1974 | Crisp et al. . | |
| 3,918,987 | 11/1975 | Kopfer . | |
| 3,992,730 | 11/1976 | Davis | 4/187 |
| 4,120,180 | 10/1978 | Jedora | 68/20 |
| 4,219,367 | 8/1980 | Cary, Jr. et al. | 4/628 |
| 4,295,233 | 10/1981 | Hinkel et al. . | |
| 4,402,331 | 9/1983 | Taldo et al. . | |
| 4,453,286 | 6/1984 | Wieland | 15/313 |
| 4,509,543 | 4/1985 | Livingston et al. | 134/113 |
| 4,670,010 | 6/1987 | Dragone | 4/623 |
| 4,688,585 | 8/1987 | Vetter . | |
| 4,769,863 | 9/1988 | Tegg et al. | 4/619 |
| 4,942,631 | 7/1990 | Rosa | 4/623 |
| 5,074,322 | 12/1991 | Jaw | 134/102.3 |
| 5,193,563 | 3/1993 | Melech . | |
| 5,257,423 | 11/1993 | Jacobsen et al. | 4/630 |
| 5,265,628 | 11/1993 | Sage et al. . | |

FOREIGN PATENT DOCUMENTS

| | | | |
|---|---|---|---|
| 2659217 | 9/1991 | France | 134/95.2 |
| 5-329065 | 12/1993 | Japan . | |

OTHER PUBLICATIONS

European Patent Application (EPO) 396,039; 4/630, Nov. 1990.

WO 80/01983; 4/630, Oct. 1983.

*Primary Examiner*—Frankie L. Stinson

*Attorney, Agent, or Firm*—Fitzpatrick, Cella, Harper & Scinto

[57] ABSTRACT

A hand washing and drying apparatus comprising a washing and drying chamber including at least one access port providing access for inserting at least one hand to be washed, wash liquid dispensing means in fluid communication with the interior of the washing and drying chamber for dispensing wash liquid within the washing and drying chamber, blow drying means in fluid communication with the interior of the washing and drying chamber for providing a directed supply of drying air within the washing and drying chamber, and towel dispensing means in communication with the interior of the washing and drying chamber for dispensing a towel, e.g., a disposable paper towel, within the chamber. The apparatus also may include vacuum disposal means for removing used towels from the washing and drying chambers and storing same. The apparatus further may include control means for controlling the operation of the apparatus.

26 Claims, 4 Drawing Sheets

AUTOMATIC HAND WASHING AND DRYING APPARATUS INCLUDING COMBINED BLOW DRYING MEANS AND TOWEL DISPENSING MEANS

BACKGROUND OF THE INVENTION

1. Field of the Invention

The present invention relates generally to hand washing and drying apparatuses, and more particularly to an automatic hand washing and drying apparatus comprising a self-contained hand washing and drying chamber including in combination a hand washing device, a blow drying apparatus and a towel dispenser.

The present invention has particular utility in environments requiring frequent hand washing and drying operations. Examples of such environments include health care facilities, such as medical and dental offices, child care facilities, industrial clean rooms, and the like. The present invention also has particular utility in food handling environments, including food processing and dispensing applications. The present invention also has particular utility in heavily used public rest rooms, for example in airports, bus and train stations, and the like. Moreover, the hand washing and drying apparatus of the present invention has utility either as a free standing unit or in addition to existing washing facilities, and may be used in any environment that utilizes hand washing and drying.

2. Related Art

In the mid 19th Century it was first scientifically proved that frequent hand washing could prevent the transmission of a specific disease. Semmelweis, a Hungarian physician working in the maternity clinics of the Vienna General Hospital, observed that the maternal mortality from puerperal fever (sepis, child bed fever) was very low in the wards of the midwives. Their act ivies were largely confined to the ward and entailed the frequent washing of hands. In contrast, in the sections staffed by doctors and medical students, the incidence of disease was high and its mortality frightening. Observing that the doctors and students often came into the maternity ward directly from the dissecting rooms, Semmelweis reasoned that they might carry the disease from the dissected cadavers to the patients. He therefore ordered the doctors and students to wash their hands in a chlorine solution before entering the maternity ward. In a few months, the mortality from child bed fever declined dramatically, and the dread disease literally was washed away, decades before the milestone discoveries of microbes, microbial and a sepsis. Studies also have demonstrated that hand washing is equally as important in many non-medical settings. Current literature in the fields of health care sanitation, and environmental protection contains many studies dealing with the transmission of disease by the hands. For example, studies have shown a significant decrease in disease transmittance in child care centers where children and providers of care are encouraged to wash frequently.

Many hand washing devices, including automatic, combined washing and drying devices are known. For example, U.S. Pat. No. 3,059,815 (Parsons), U.S. Pat. No. 3,992,720 (Davis), U.S. Pat. No. 4,295,233 (Hinkel), and U.S. Pat. No. 5,074,322 (Jaw) relate to hand washing and drying stations having an open configuration for accessing a hand washing device or a hand washing and drying device. U.S. Pat. No. 4,817,651 (Crisp), U.S. Pat. No. 4,402,331 (Taldo), U.S. Pat. No. 3,918,987 (Kopfer), U.S. Pat. No. 3,757,806 (Bhasker) U.S. Pat. No. 4,688,585 (Vetter), U.S. Pat. No. 5,193,563 (Melech), U.S. Pat. No. 4,219,367 (Cary) and U.S. Pat. No. 5,265,628 (Sage) all relate to an automatic, contained, hand washing device generally including a pair of insertion ports for individually receiving a users hands and forearms to wash or wash and dry same.

Although each of these devices may have advantages in certain applications, each has drawbacks. Wash stations that are not entirely enclosed often result in splashing of water when used. Drying by means of a towel, now usually made of disposable paper, requires the user to dispose of the towel in a designated receptacle, and often results in the dispersal of wet towels outside of the designated receptacle. Many hot air blow dryer devices are known. However, such blow dryer devices require a drying cycle in excess of one minute, often too long for the impatient or hurried user. Moreover, air blowing devices not completely enclosed spray water and disseminate particulate matter into the environment. It is commonly observed that in rest rooms, the wash basin, soap dispenser, towel dispenser and disposal are usually at some distance from each other, resulting in splashing, ineffective use of receptacles, and an unclean and unsafe environment, such that the potential user often walks away, even in a setting in which washing of the hands is mandatory.

SUMMARY OF THE INVENTION

It is therefore an object of the present invention to provide an improved hand washing and drying apparatus.

It is another abject of the present invention to provide an improved hand washing and drying apparatus that is self-contained in a closed system.

It is another object of the present invention to provide an improved hand washing and drying apparatus in which no water is splashed outside the apparatus.

It is another object of the present invention to provide an improved hand washing and drying apparatus in which no air containing particulate matter is diffused to the outside of the apparatus.

It is another object of the present invention to provide an improved hand washing and drying apparatus that is inexpensive and easy to make.

It is another object of the present invention to provide an improved hand washing and drying apparatus that is readily adaptable to a wide range of applications.

It is another object of the present invention to provide an improved hand washing and drying apparatus that facilitates compliance with legal and social standards of cleanliness and safety.

These and other objects and advantages are achieved by the automatic hand washing and drying apparatus of the present invention which in one aspect includes a washing and drying chamber including at least one access port providing access for inserting at least one hand to be washed, wash liquid dispensing means in fluid communication with the interior of the washing and drying chamber for dispensing wash liquid within the washing and drying chamber, blow drying means in fluid communication with the interior of the washing and drying chamber for providing a directed supply of drying air within the washing and drying chamber, and towel dispensing means in communication with the interior of the washing and drying chamber for dispensing a towel, e.g., a disposable paper towel, within the chamber.

In another aspect, the apparatus also may include vacuum disposal means for removing used towels from the washing and drying chambers and storing same.

In another aspect, the apparatus may include control means for controlling the operation of the apparatus. In one embodiment, the control device may include a sensor, e.g., located at an access port, for detecting the presence of a users hands and controlling an automatic operation cycle of the wash liquid dispensing means, the towel dispensing, the blow drying means and the vacuum disposal means. In another embodiment, the control means may include external control devices, such as foot pedals, for individually controlling the operation of the wash liquid dispensing means, the towel dispensing means, the blow drying means, and the disposal means.

These and other objects, advantages and features of the present invention readily will be understood and appreciated more fully when viewed in conjunction with the following detailed description of the preferred embodiment and the accompanying drawings.

DETAILED DESCRIPTION OF THE PREFERRED EMBODIMENTS

Figure 1:
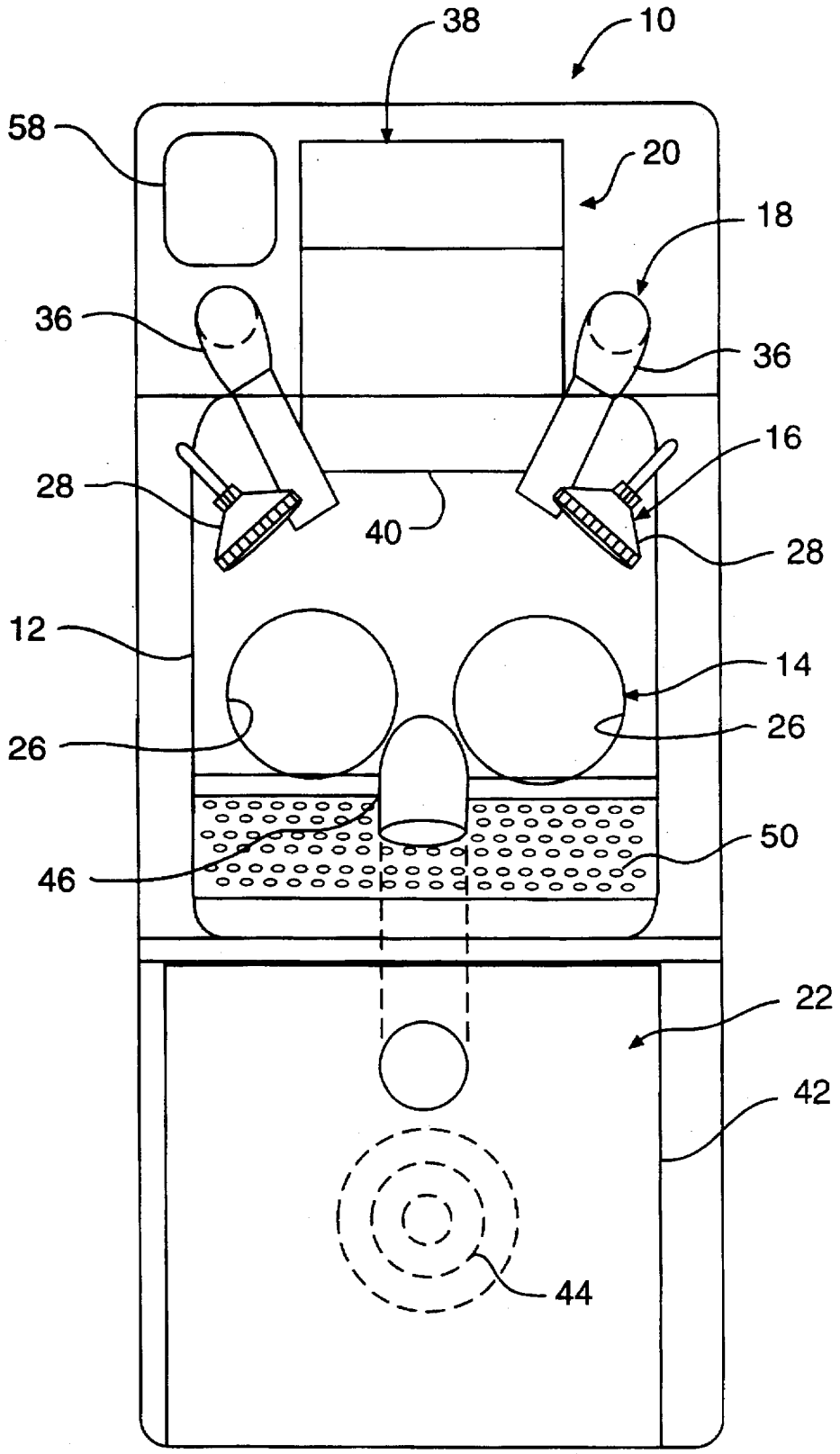
FIG. 1 is a front view schematically illustrating a first embodiment of a hand washing and drying apparatus of the present invention.
Figure 2:
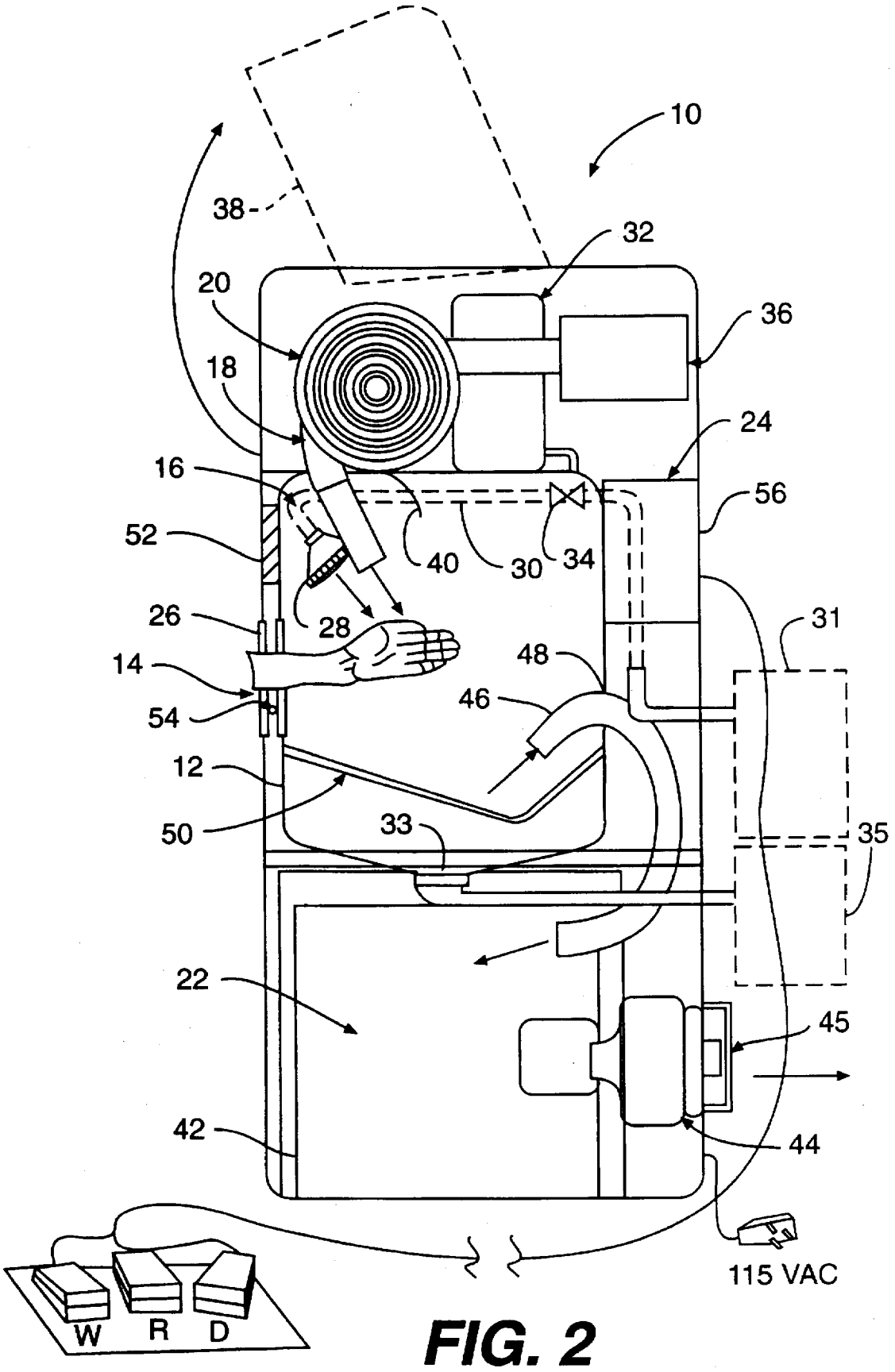
FIG. 2 is a side view schematically illustrating in cross section the hand washing and drying apparatus of FIG. 1.

Referring now to the drawings, wherein like or similar reference numerals designate like or similar elements throughout the application, FIGS. 1 and 2 illustrate a first embodiment of the present invention.

FIG. 1 is a front view schematically illustrating a first embodiment of a hand washing and drying apparatus of the present invention, and FIG. 2 is a side view schematically illustrating in cross section the hand washing and drying apparatus of FIG. 1. As shown therein, the hand washing and drying apparatus 10 generally includes a washing and drying chamber 12 including access port means 14, wash liquid dispensing means 16, blow drying means 18, and towel dispensing means 20. The washing and drying apparatus preferably also includes vacuum disposal means 22 and control means 24 for controlling the washing and drying apparatus 10.

In the embodiment of FIGS. 1 and 2, the washing and drying chamber 12 is a contained (substantially closed) chamber, and includes a pair of access ports 26 for individual insertion of the users hands. Of course, the chamber 12 could be provided with a single access port for entry of both hands together. The washing and drying apparatus, including the washing and drying chamber 12, may be made of any material suitable for the intended environment, such as plastic, metal, and the like. In the preferred embodiment, the apparatus and housing is made of a molded plastic for ease of manufacture and reduced cost. Those skilled in the art readily will be able to select the various alternative materials and method of manufacture, as well as structure of the access ports, to achieve any desired configuration.

The wash liquid dispensing means 14 of FIGS. 1 and 2 includes a pair of shower heads 28, a supply line 30, a water source 31 (shown in phantom) and a soap dispenser 32. In the present embodiment two shower heads 28 are provided on opposite sides of the washing and drying chamber 12 above and proximate the access ports 26, so that washing liquid is dispensed in a direction into the interior of the chamber 12 (toward the users hands) and generally away from the access ports 26, to maximize efficient washing of the users hands and minimize or eliminate spraying of washing liquid out of the chamber 12. The soap dispenser 32 preferably is a liquid soap dispenser in fluid communication with the water supply line 30, so that liquid soap in the soap dispenser 32 is drawn out of the soap dispenser 32 with the supply of water through the water supply line 30 in a controlled manner, e.g., by a valve 34. Each of these elements is conventionally available, and those skilled in the art readily will be able to select alternative shower heads 28, soap dispensers 32 and valves 34 (or other means for dispensing washing liquid, including soap, into the interior of the washing and drying chamber 12), as well as their location and orientation, for achieving the desired application of washing liquid.

The water source 31 may be an existing plumbing line or a self-contained water source, e.g., provided as a portion of the apparatus 10. Likewise, a drain 35 and drain line may be provided to an existing plumbing line, or to a holding tank 35 (shown in phantom), for storage of used wash liquid, e.g., provided as a portion of the apparatus 10. In this manner, it will be apparent that the apparatus 10 may be configured as a fixed unit, a mobile unit attachable to an existing plumbing fixture (sink), or a self-contained mobile unit. Those skilled in the art readily will be able to adapt the apparatus of the present invention to numerous desired environments.

The blow drying means 18 of the present embodiment generally includes a pair of hot air blow dryers 36. Like the shower heads 28, the hot air blow dryers 36 preferably are located on opposite sides of the washing and drying chamber 12 and oriented to direct a stream of heated air in a direction into the interior of the chamber 12 (toward the users hands) and generally away from the access ports 26. While in the preferred embodiment the blow dryers 36 blow hot or heated air, in some applications it may be sufficient merely to provide a stream of air at room temperature. Those skilled in the art readily will be able to adapt conventional blow dryers to achieve any desired configuration and application of drying air to the users hands.

Figure 3:
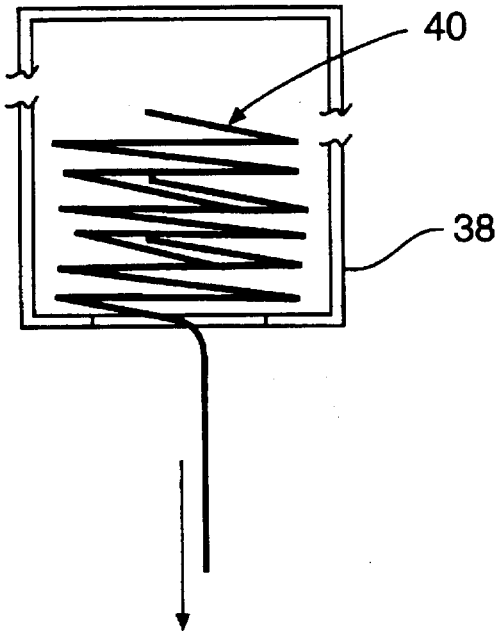
FIG. 3 is an enlarged schematic view of a towel dispensing device of the hand washing and drying apparatus of FIGS. 1 and 2, utilizing a plurality of individual towels interleaved.
Figure 4:
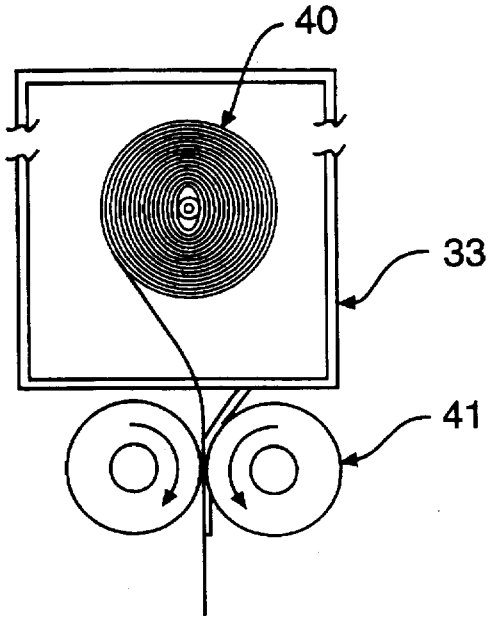
FIG. 4 is an enlarged schematic view of an alternative towel dispensing device of the hand washing and drying apparatus of FIGS. 1 and 2, utilizing a continuous roll of towels fed one-by-one by a motor driven roller.

FIGS. 3 and 4 illustrate two alternative embodiments of towel dispensing means 20 which may be utilized in the embodiment of FIGS. 1 and 2. In each embodiment, the towel dispensing means 20 includes a towel dispenser housing or container 38 and a plurality of towels 40. The towel dispenser container 38 preferably is disposed in an upper portion of the washing and drying apparatus 10 above the washing and drying chamber 12 and proximate the access ports 26. This allows the user to reach up to obtain a towel 40 without withdrawing the hands from the washing and drying chamber 12. This location also minimizes any splashing of water from the wash liquid dispensing means 14 on the towels 40.

In the embodiment of FIG. 3, the towel dispensing means 20 includes a towel dispenser housing 38 that contains a plurality of individual towels 40 folded in an interleaved manner. The plurality of towels 40 thus may be manually dispensed one-by-one into the interior of the chamber 12, and the user is free to use as many towels as desired.

In the embodiment of FIG. 4, the towel dispensing means 20 includes a towel dispenser housing 38 that contains a continuous roll of towels 40, e.g., prescored or perforated to permit dispensing one-by-one. The towel dispensing means 20 also is shown including an optional pair of motor driven rollers 41, to facilitate dispensing of the towels 40 one-by-one.

In the preferred embodiment, the towels 40 are disposable paper towels. The present inventors have identified Scott brand shop quality paper towels as suitable for the present embodiment. However, those skilled in the art readily will be able to identify alternative towels having a softness and absorbency sufficient to satisfy the objectives of the present invention.

In the embodiment of FIGS. 1 and 2, the vacuum disposal means 22 generally includes a vacuum chamber 42, a vacuum pump 44, a vacuum line 46, a vacuum port 48 formed in the washing and drying chamber 12, and an optional deflection screen 50 disposed in a bottom portion of the washing and drying chamber 12 above the drain. The vacuum pump 44 is provided in fluid communication with the interior of the vacuum chamber 42 to evacuate air therefrom, thereby to generate a vacuum therein. The vacuum pump 44 preferably also includes a filter 45 to filter out any contaminate particulate matter collected in the vacuum chamber 42. The vacuum line 46 is provided between the vacuum chamber 42 and the vacuum port 48 to generate a vacuum at the vacuum port 48 sufficient to evacuate spent towels 40 disposed of in the washing and drying chamber 12. The deflection screen 50 catches towels 40 disposed of in the chamber 12 and deflects same to the vacuum port 48 for evacuation and disposal. Towels 40 evacuated from the interior of the washing and drying chamber 12 thus are collected in vacuum chamber 42 for disposal in bulk.

The washing and drying chamber 12 preferably is provided with a clear window panel 52 to allow the user to observe his or her hands within the chamber 12. The interior face of the panel 50 also is preferably treated or coated so that it is hydrophilic, to facilitate sheeting action of washing liquid that splashes onto the panel, thereby permitting clear viewing and eliminating a claustrophobic effect often experienced with conventional, automatic, self-contained washing and drying system.

In operation, the users hands are inserted into the hand washing and drying chamber 12 through the access ports 26, which is detected by sensors 54 located at the access ports 26. The sensors 54 provide a detection signal to a control unit 56, such as a microprocessor, which initiates a washing cycle. In the washing cycle, washing liquid is provided from the water supply line 30 to the pair of shower heads 28 to spray the users hands resident in the washing and drying chamber 12. The control unit also controls the valve 34 to provide an appropriate supply of soap during at least a portion of the washing cycle.

Upon completion of the washing cycle, the control unit initiates a drying cycle. In the drying cycle, the user first reaches up and withdraws a single towel from the towel dispenser housing 38 (FIG. 3 embodiment). Alternatively, the motor driven rollers 41 of the towel dispensing means 20 are activated by a control signal from the control unit 56, and the motor driven rollers 38 are rotated to advance a single towel 40 from the towel dispenser housing 38 so that it is accessible to the users hands (FIG. 4 embodiment). The user then rubs and/or lightly dabs his or her hands with the towel 40 to remove a substantial portion of the washing liquid from the hands. The control unit 56 meanwhile continues the drying cycle by activating the pair of blow dryers 36 to provide one or more directed streams of drying air onto the users hands. Of course, this portion of the drying cycle may be simultaneous with the disposing of the paper towel 40, or it may be delayed to provide sufficient time for the user to first use the towel 40 dispensed from the towel dispensing means 20. The user may discard the paper towel 40, e.g., to the bottom of the washing and drying chamber 12, at any time during the drying cycle. In this manner, the user obtains the combined drying advantages of a towel 40 and directed air drying (e.g., heated air drying), resulting in clean, dry hands in a matter of seconds. Moreover, since the drying cycle requires only a few seconds of drying (heated) air, the user's hands are not burned or otherwise irritated after extended and/or repeated use. The user then withdraws his or her hands from the washing and drying chamber 12.

The withdrawal of the user's hands is detected by the sensors 54, which then provide a detection signal to the control unit 56 to activate a disposal cycle. At this time, the vacuum pump 44 is activated creating a vacuum in the vacuum chamber 22 sufficient to exhaust the disposed towel 40 from the washing and drying chamber 12 into the vacuum chamber 22 where it is stored for later disposal. Alternatively, the vacuum disposal means 22 may be activated simultaneously with the blow drying means 20. Applicant has found this alternative method to reduce any fogging of the washing and drying chambers.

FIG. 2 also illustrates an optional embodiment including exterior manual control means. In this embodiment, three foot pedals W,R,D are provided for operating a Washing cycle, a Rinsing cycle, and a Drying/Disposing cycle, respectively. The foot pedals are electronically connected to the control unit 56 of the control means 24, and may be used to selectively control the respective cycles, either independently of, or in conjunction with, an automatic cycle sequence programmed in the control unit 56. Those skilled in the art readily will be able to select alternative external control devices, such as audio/microphone driven control devices, and control sequences for achieving the desired function.

FIG. 1 also illustrates in phantom an optional embodiment including an audio/visual display 58. The audio/visual display may be a simple chart with written instructions for the user. Alternatively, the display 58 may be an audio speaker, an electronic video monitor, or a combination thereof, and the control unit 56 of the control means 24 may be electronically connected to the display 58 to provide instructions to the user. Those skilled in the art readily will recognize numerous alternative embodiments for providing such instructions.

Figure 5:
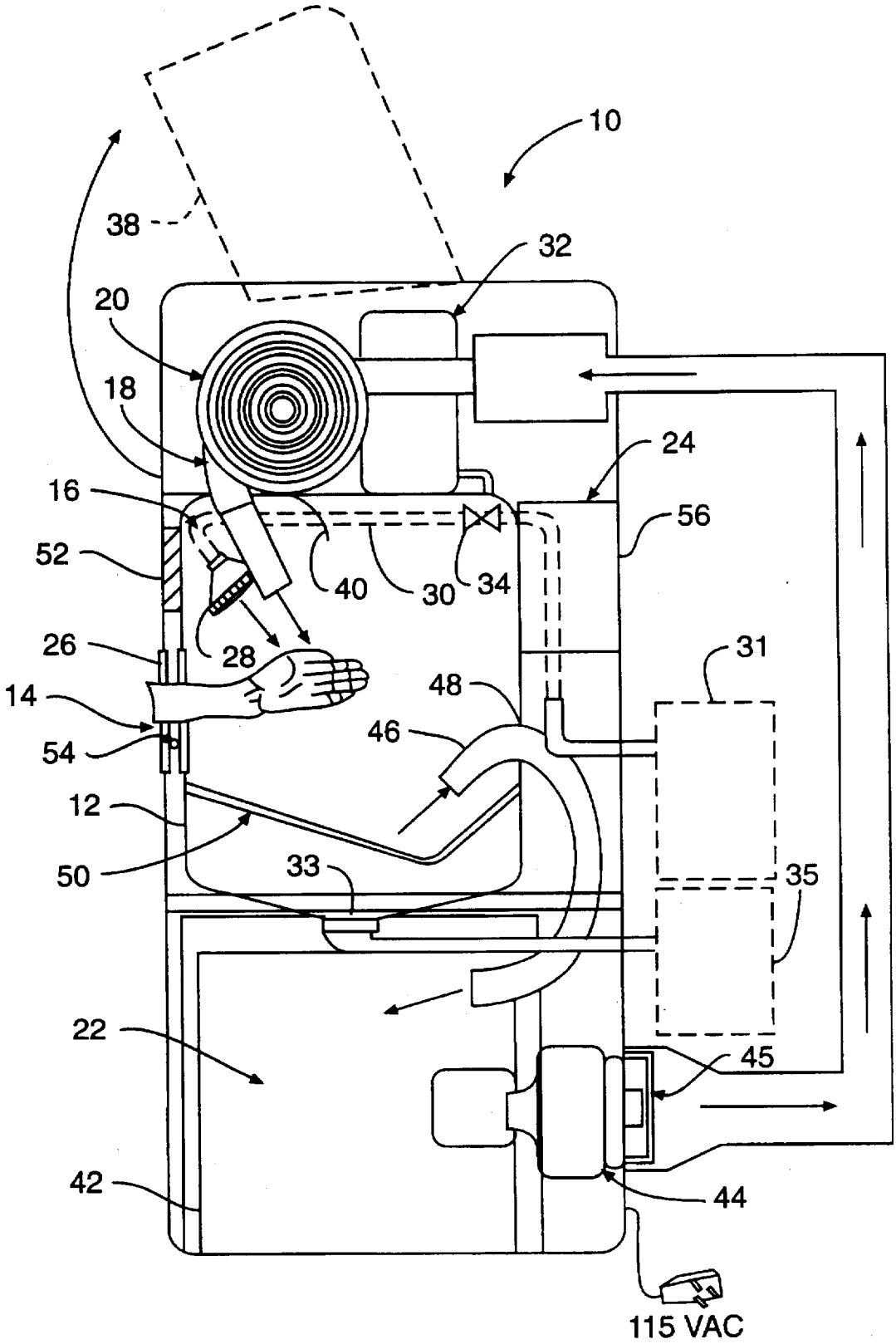
FIG. 5 is a side view taken in cross section schematically illustrating a second embodiment of a hand washing and drying apparatus of the present invention utilizing a combined vacuum disposal means and blow drying means.

FIG. 5 is a side view schematically illustrating in cross section an alternative embodiment of a hand washing and drying apparatus of the present invention. In the embodiment of FIG. 5, the washing and drying apparatus 10 is substantially the same as in the embodiment of FIG. 1. Similar elements and features are designated with the same reference numerals and will not be described again. The embodiment of FIG. 5 differs from the embodiment of FIG. 1 in that, in FIG. 5, the exhaust of the vacuum pump 44 and filter 45 is recycled and used as part of the blow drying means 18, for generating a directed stream of drying air into the washing and drying chamber 12. This may provide significant savings in parts and assembly. The operation of the washing and drying apparatus of FIG. 5 is substantially the same as that in FIGS. 1 and 2.

Accordingly, it will be appreciated that the above disclosed embodiments achieve all of the objectives, advantages and features recited above.

Although specific embodiments of the present invention have been described above in detail, it will be understood that this description is merely for purposes of illustration. Various modifications of and equivalent structures corresponding to the preferred embodiments in addition to those described above may be made by those skilled in the art without departing from the spirit of the present invention which is defined in the following claims, the scope of which is to be accorded the broadest interpretation so as to encompass such modifications and equivalent structures.

What is claimed is:

1. A hand washing and drying apparatus comprising:

a washing and drying chamber including at least one access port providing access for inserting at least one hand to be washed;

wash liquid dispensing means for dispensing wash liquid within said washing and drying chamber;

blow drying means for providing a directed supply of drying air within said washing and drying chamber; and towel dispensing means for dispensing a towel within said washing and drying chamber.

2. An apparatus as recited in claim 1, further comprising vacuum disposal means for exhausting the interior of said washing and drying chamber.

3. An apparatus as recited in claim 2, wherein said vacuum disposal means comprises a vacuum chamber in fluid communication with said washing and drying chamber through a vacuum port in a wall of said washing and drying chamber.

4. An apparatus as recited in claim 3, wherein said vacuum disposal means further comprises a vacuum pump and a filter.

5. An apparatus as recited in claim 4, wherein said blow drying means comprises an exhaust of said vacuum disposal means.

6. An apparatus as recited in claim 3, wherein said blow drying means comprises an exhaust of said vacuum disposal means.

7. An apparatus as recited in claim 2, wherein said blow drying means comprises an exhaust of said vacuum disposal means.

8. An apparatus as recited in claim 2, further comprising control means for controlling an operation of said wash liquid dispensing means, said blow drying means, said towel dispensing means and said vacuum disposal means.

9. An apparatus as recited in claim 8, wherein said control means includes sensor means for sensing the presence of a user's hand within said washing and drying chamber.

10. An apparatus as recited in claim 9, further comprising instruction means responsive to said control means for providing instructions for use of said apparatus.

11. An apparatus as recited in claim 10, wherein said instruction means provides audio visual instructions for use of said apparatus.

12. An apparatus as recited in claim 8, wherein said control means includes manual control means disposed exterior to said washing and drying chamber.

13. An apparatus as recited in claim 12, further comprising instruction means for providing instructions for use of said apparatus.

14. An apparatus as recited in claim 13, wherein said instruction means provides audio visual instructions for use of said apparatus.

15. An apparatus as recited in claim 1, further comprising a drain at the bottom of said washing and drying chamber.

16. An apparatus as recited in claim 15, further comprising a screen disposed at a bottom portion of the interior of said washing and drying chamber.

17. An apparatus as recited in claim 1, wherein said towel dispensing means comprises a storage container containing a plurality of towels.

18. An apparatus as recited in claim 17, wherein said towel dispensing means further comprises a motor driven roller for dispensing at least one of said plurality of towels from the storage container.

19. An apparatus as recited in claim 17, wherein said storage container stores said plurality of towels folded in an interleaved manner.

20. An apparatus as recited in claim 17, wherein said storage container stores said plurality of towels as a continuous roll.

21. An apparatus as recited in claim 17, wherein said storage container comprises motor driven rollers for dispensing said plurality of towels one-by-one.

22. An apparatus as recited in claim 17, wherein said plurality of towels are paper towels.

23. An apparatus as recited in claim 1, further comprising a reservoir for storing washing fluid.

24. An apparatus as recited in claim 1, further comprising control means for controlling an operation of said wash liquid dispensing means, said blow drying means and said towel dispensing means.

25. A hand washing and drying apparatus comprising:

a washing and drying chamber including at least one access port providing access for inserting at least one hand to be washed;

a wash liquid dispenser arranged in fluid communication with the interior of said washing and drying chamber to dispense wash liquid within said washing and drying chamber;

a blow dryer arranged in fluid communication with the interior of the washing and drying chamber to provide a directed supply of drying air within said washing and drying chamber; and a towel dispenser arranged in communication with the interior of the washing and drying chamber to dispense a towel within said washing and drying chamber.

26. A hand washing and drying apparatus comprising:

a washing and drying chamber including at least one access port providing access for inserting at least one hand to be washed;

a wash liquid dispenser arranged in fluid communication with the interior of said washing and drying chamber to dispense wash liquid within said washing and drying chamber;

a blow dryer arranged in fluid communication with the interior of the washing and drying chamber to provide a directed supply of drying air within said washing and drying chamber;

a towel dispenser arranged in communication with the interior of the washing and drying chamber to dispense a towel within said chamber; and a vacuum disposal arranged in fluid communication with said washing and drying chamber.

* * * * *

UNITED STATES PATENT AND TRADEMARK OFFICE

CERTIFICATE OF CORRECTION

PATENT NO. : 5,727,579

DATED : March 17, 1998

INVENTOR(S) : WILLIAM M. CHARDACK

It is certified that error appears in the above-identified patent and that said Letters Patent is hereby corrected as shown below:

Column 1

Line 36, "act ivies" should read --activities--.

Signed and Sealed this

Twenty-third Day of November, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,727,579
DATED : March 17, 1998
INVENTOR(S) : William M. Chardack

It is certified that error appears in the above-identified patent and that said Letters Patent is hereby corrected as shown below:

Add item [73] Assignee: 144 Limited Partnership, New Canan, Connecticut

Signed and Sealed this

Fifteenth Day of May, 2001

*Attest:*

Nicholas P. Godici

NICHOLAS P. GODICI

*Attesting Officer*

*Acting Director of the United States Patent and Trademark Office*